United States Patent [19]

Kakuda et al.

[11] Patent Number: 5,066,206

[45] Date of Patent: Nov. 19, 1991

[54] FLUID SCROLL MACHINE WITH TORQUE TRANSMITTING COUPLING BETWEEN SCROLLS

[75] Inventors: Masayuki Kakuda; Shin Sekiya; Yoshihisa Kitora, all of Hyogo, Japan

[73] Assignee: Mitsubishi Denki K.K., Tokyo, Japan

[21] Appl. No.: 494,344

[22] Filed: Mar. 16, 1990

[30] Foreign Application Priority Data

May 11, 1989 [JP] Japan ..... 1-117923

[51] Int. Cl.[5] ..... F01C 1/04; F01C 17/06; F16D 3/04

[52] U.S. Cl. ..... 418/55.3; 418/188; 464/102

[58] Field of Search ..... 418/55.3, 188; 464/102, 464/104

[56] References Cited

U.S. PATENT DOCUMENTS

| | | | |
|---|---|---|---|
| 2,475,247 | 7/1949 | Mikulasek | 418/55.3 |
| 3,884,599 | 5/1975 | Young et al. | 418/55.3 |
| 4,178,143 | 12/1979 | Thelen et al. | 418/19 |
| 4,440,123 | 4/1984 | Tsai | 464/102 |
| 4,610,610 | 9/1986 | Blain | 418/14 |
| 4,753,582 | 6/1988 | Morishita et al. | 418/57 |
| 4,941,861 | 7/1990 | Painter | 464/102 |

FOREIGN PATENT DOCUMENTS 64302 1/1989 Japan .

*Primary Examiner*—John J. Vrablik

*Attorney, Agent, or Firm*—Sughrue, Mion, Zinn, Macpeak & Seas

[57] ABSTRACT

A fluid scroll machine including two scrolls eccentrically combined with each other and defining a hermetically closed space which moves as the scrolls are rotated synchronously with each other, wherein the central parts of the vortical portions of the scrolls are notched so that an opening is provided between the scrolls; and an Oldham's coupling for transmitting the torque of one of the scrolls to the other is provided in the opening.

1 Claim, 4 Drawing Sheets

FLUID SCROLL MACHINE WITH TORQUE TRANSMITTING COUPLING BETWEEN SCROLLS

BACKGROUND OF THE INVENTION

The present invention relates to a fluid scroll machine including a driving scroll and a driven scroll.

Various fluid scroll machines are known to the public. One of them is a fluid scroll machine of the so-called overall system rotation type. This machine is conventionally constituted as shown in FIG. 4. The machine comprises an upper cylindrical casing 1, a lower cylindrical casing 2, an O-ring 5, a cover 8, an O-ring 9, an intake plug 16, an exhaust plug 17, a driving scroll 18, a driving shaft 23, a driven scroll 28, a driven shaft 32, an Oldham's coupling 35, a vane pump 38, and a motor 49. The upper casing 1 has an exhaust chamber 3. The lower casing 2 has an intake chamber 4. The casings 1 and 2 are connected to each other in such a manner that the O-ring 5 is interposed between them. A partition wall 7, which defines an intake passage 6 open downward, is provided in the upper casing 1. The cover 8, which closes the lower open end of the lower casing 2, is fitted to the casing in such a manner that the O-ring 9 is a interposed between them. A bearing support 10, which divides the exhaust chamber 3 and the intake chamber 4 from each other, is provided in the lower casing 2, and has a communication hole 11 communicating with the intake passage 6 and the intake chamber 4. An O-ring 12 is interposed between the upper and the lower casings 1 and 2 around the ends of the communication hole 11 and the intake passage 6. The bearing support 10 has an oil feed passage 15 for supplying lubricating oil 13 from the exhaust chamber 3 to a bearing fitting portion 14. The intake plug 16, whose through opening communicates with the intake passage 6 and the exterior of the upper casing 1, is fitted in the peripheral wall of the casing. The exhaust plug 17, whose through opening communicates with the exhaust chamber 3 and the exterior of the upper casing 1, is fitted in the peripheral wall of the casing. The driving scroll 18 has a circular base plate not shown in FIG. 4, and is provided in the intake chamber 4. The driving scroll 18 has a discharge port 19 in the central portion of the scroll and a suction port 20 in the peripheral portion of the scroll. Two U-shaped arms 21 and 22 are secured to the upper side of the base plate of the driving scroll 18 in such a manner that the arms are located away from each other at an angular interval of 180 degrees in the circumferential direction of the base plate. The driving shaft 23 extends in the axial direction of each of the casings 1 and 2, and is rotatably supported with bearings 24 and 25 by the partition wall 7 and the bearing support 10 and coupled to the central portion of the driving scroll 18. The driving shaft 23 has an exhaust passage 26 communicating with the discharge port 19, and an oil feed passage 27 communicating with a hermetically closed space 29 described hereinafter. The driven scroll 28 has a circular base plate facing that of the driving scroll 18 but not shown in FIG. 4, and is provided in the intake chamber 4 and eccentrically combined with the driving scroll. The driving and the driven scrolls 18 and 28 define the hermetically closed space 29 (as a compression chamber) that moves from the peripheral portions of the scrolls toward the central portions thereof as the scrolls are rotated synchronously with each other. Two projections 30 and 31 are provided on the lower side of the base plate of the driven scroll 28 in such a manner that the projections are opposed to each other along the perpendicular bisector of the straight line extending through both the U-shaped arms 21 and 22, as shown in FIG. 5. The driven shaft 32 extends in the axial direction of the driving shaft 23, and is rotatably supported with bearings 33 and 34 by the cover 8 and coupled to the central portion of the driven scroll 28. The Oldham's coupling 35 for transmitting torque from the driving scroll 18 to the driven scroll 28 is provided in the intake chamber 4, and comprises an annular portion 36 through which the driven shaft 32 extends, and guides 37 having U-shaped openings 37a in which the projections 30 and 31 and the lower ends of the U-shaped arms 21 and 22 are fitted, as shown in FIG. 5. The vane pump for supplying the lubricating oil 13 to the hermetically closed space 29 is provided around the driving shaft 23 and secured with an O-ring 39 to the bearing support 10. The vane pump 38 comprises a casing 44 having a first oil feed passage 40 opened into the lubricating oil 13, a second oil feed passage 41 communicating with the oil feed passage 15, and a third oil feed passage 43 capable of being connected to the second oil feed passage at the time of opening of a check valve 42, a cover 46 closing the casing and containing a spring 45 for pushing the check valve, a rotor 47 provided inside the casing and the cover and secured to the driving shaft 23, and vanes 48 provided on the peripheral portion of the rotor and located inside the casings. The motor 49 for driving the fluid scroll machine is provided outside the upper casing 1. The rotary shaft 50 of the motor 49 is coupled to the driving shaft 23 by a coupling 51. A fan 52 is secured to the rotary shaft 50, and faces the interior of the upper casing 1. Oil seals 53 and 54 are provided on the driving shaft 23.

When the driving scroll 18 of the fluid scroll machine shown in FIG. 4 is rotated by the motor 49, the torque of the scroll is transmitted to the driven scroll 28 through the Oldham's coupling 35. At that time, a fluid is sucked into the upper casing 1 through the intake plug 16, passes through the intake passage 6 and the intake chamber 4 and flows in between both the scrolls 18 and 28 so that the fluid is compressed in the hermetically closed space 29 and thereafter discharged to the exterior of the upper casing through the exhaust passage 26, the exhaust chamber 3 and the exhaust plug 17. A portion of the lubricating oil 13 in the intake chamber 4 is drained to the peripheral portions of the scrolls 18 and 28 due to the centrifugal force, while the other portion of the lubricating oil flows in between the scrolls and is then drained together with the sucked fluid into the exhaust chamber 3 through the exhaust passage 26. For that reason, the amount of the lubricating oil 13 in the intake chamber 4 is decreased so that the quantity of the lubricating oil supplied to the sliding surfaces of the scrolls 18 and 28 would become insufficient to lower the hermetic sealing of the sliding surfaces. However, the lubricating oil 13 in the exhaust chamber 3 is supplied in between the scrolls 18 and 28 by the vane pump 38 to prevent the hermetic sealing of the sliding surfaces from being lowered. In other words, since the rotor 47 of the vane pump 38 is rotated together with the driving shaft 23, the lubricating oil 13 in the exhaust chamber is sucked into the casing 44 of the vane pump through the first oil feed passage 40 and discharged into the third oil feed passage 43 so that the pressure of the discharged oil opens the check valve 42 to allow the oil to flow into the second oil feed passage 41. For that reason, the lubricating oil 13 is supplied into the hermetically closed space 29 between the scrolls 18 and 28 through the oil feed passage 15 so that the quantity of the lubricating oil between the scrolls is kept adequate. When the rotation of the rotor 47 is stopped, the vane pump 38 is put out of action so that the check valve 42 is closed.

Since the conventional fluid scroll machine shown in FIG. 4 needs to have the U-shaped arms 21 and 22 to transmit the rotation of the driving scroll 18 to the driven scroll 28, the number of the components of the machine is not only increased but also the manufacturing of the machine is made troublesome, so that the cost of the machine is augmented. This is a problem. Since the Oldham's coupling 35 has the annular portion 36 through which the driven shaft 32 extends, the inside diameter of the annular portion needs to be larger than the diameter of the driven shaft so as to make it likely that a vibration occurs due to the movement of the Oldham's coupling during the use of the machine. This is another problem. Since the Oldham's coupling 35 is exposed to the interior of the intake chamber 4, the lubricating oil 13 on the peripheral portion of the coupling is flown therefrom to the inside circumferential surface of the lower casing 2 due to the centrifugal force so that the lubrication of the coupling becomes inadequate. This is yet another problem.

SUMMARY OF THE INVENTION

The present invention was made in order to solve the above-mentioned problem.

Accordingly, it is an object of the present invention to provide a fluid scroll machine reduced in the cost of production thereof and prevented of the vibration of an Oldham's coupling and the insufficiency of the supply of lubricating oil to the coupling during the use of the machine. The fluid scroll machine includes two scrolls eccentrically combined with each other and defining a hermetically closed space. The fluid scroll machine is characterized in that the central parts of the vortical portions of the scrolls are notched so that an opening is provided between the scrolls; and the Oldham's coupling for transmitting torque from one of the scrolls to the other is provided in the opening.

Since both the scrolls are coupled to each other by the Oldham's coupling located inside the scrolls, the fluid scroll machine does not need to have U-shaped arms to transmit the rotation of one of the scrolls to the other as in the conventional fluid scroll machine described above. For that reason, the number of the components of the fluid scroll machine provided in accordance with the present invention is decreased and the manufacturing of the machine is simplified, so that the cost of the machine is reduced. Since both the scrolls are directly coupled to each other by the Oldham's coupling, the diameter of the coupling can be made smaller than that of the shaft of each of the scrolls so as to surely prevent the coupling from vibrating during the use of the machine. Since the Oldham's coupling is located in the opening inside the scrolls, the coupling is surely and sufficiently lubricated with oil supplied in between the scrolls.

DESCRIPTION OF THE DRAWINGS

FIG. 3(*b*) is a plan view of the driven scroll of the fluid scroll machine;

DETAILED DESCRIPTION OF EXEMPLARY EMBODIMENT

An embodiment of the present invention is hereafter described in detail with reference to the drawings attached hereto.

Figure 1:
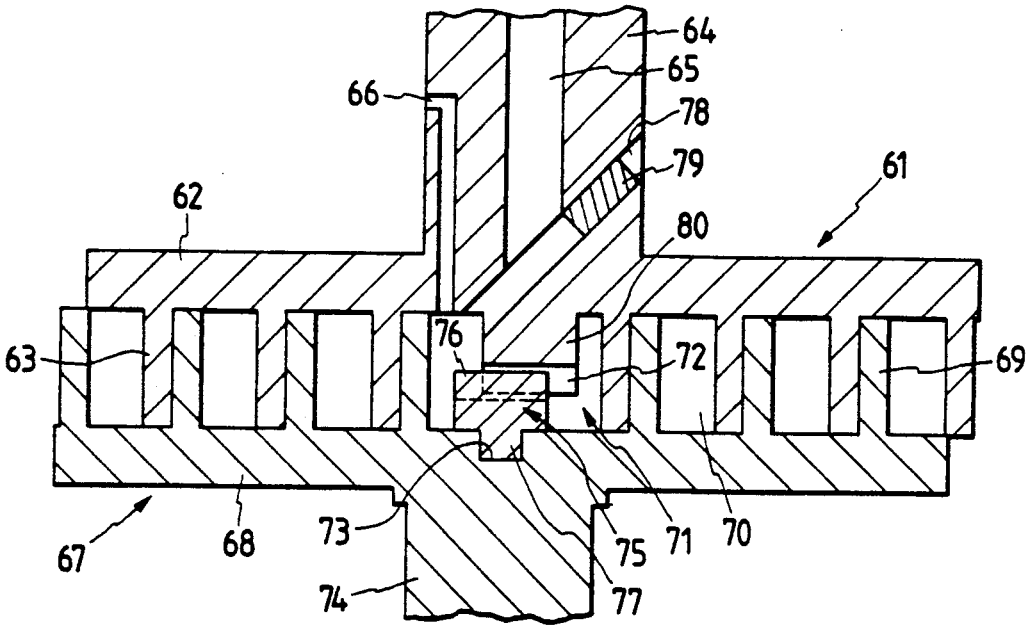
FIG. 1 is a sectional view of a major part of a fluid scroll machine which is an embodiment of the present invention.
Figure 5:
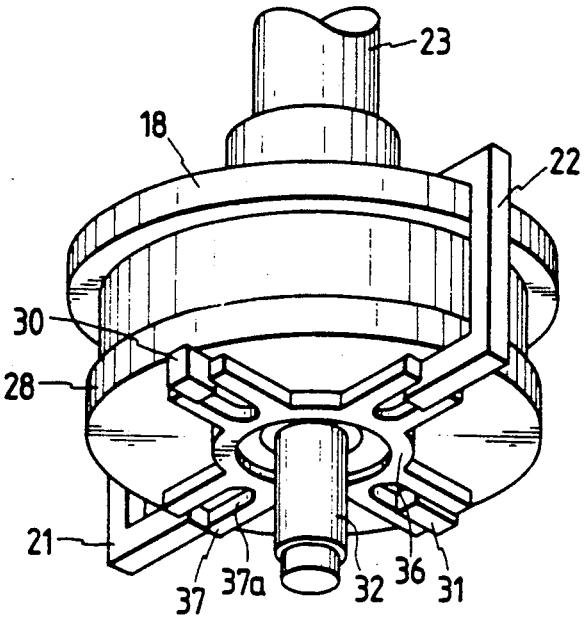
FIG. 5 PRIOR ART
FIG. 5 is a perspective view of the Oldham's coupling of the conventional fluid scroll machine and the vicinity of the coupling.
Figure 2:
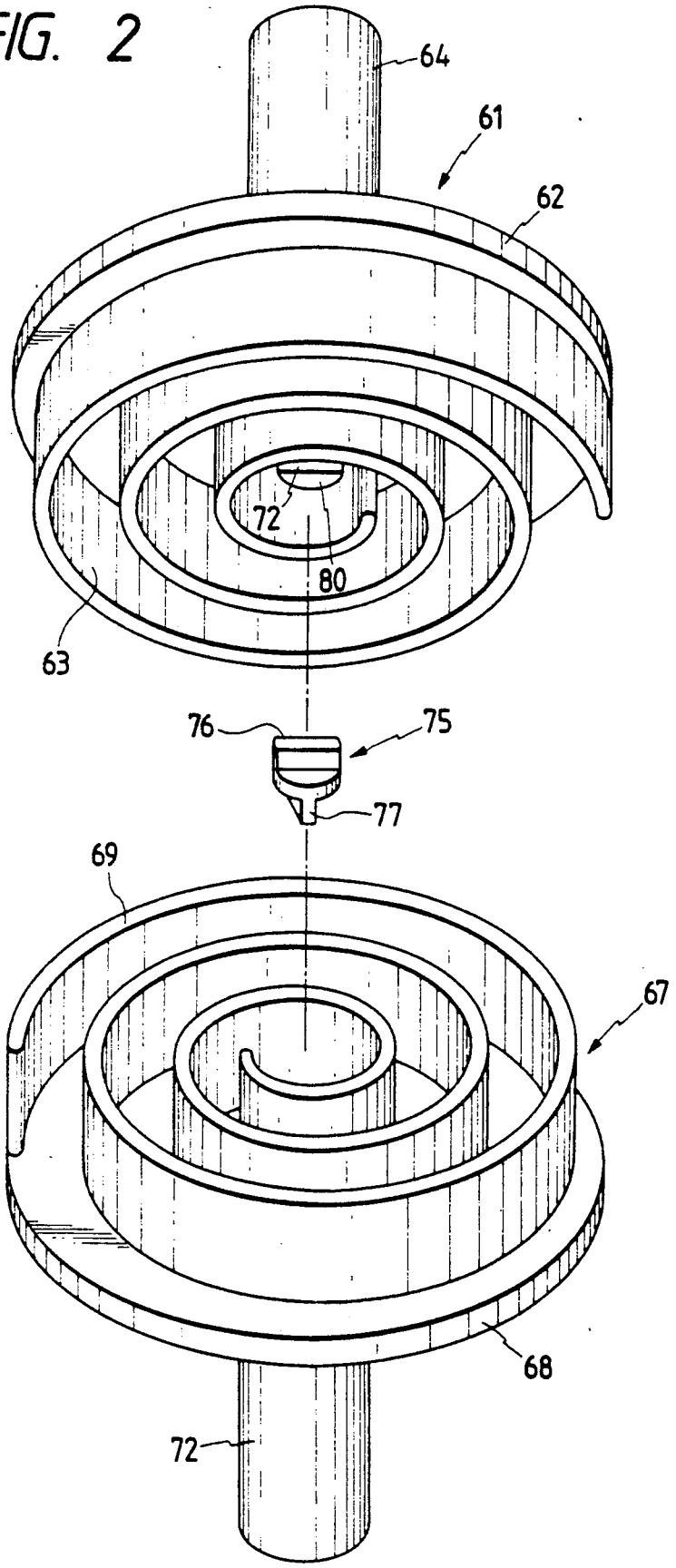
FIG. 2 is a perspective exploded view of the major part.
Figure 3B:
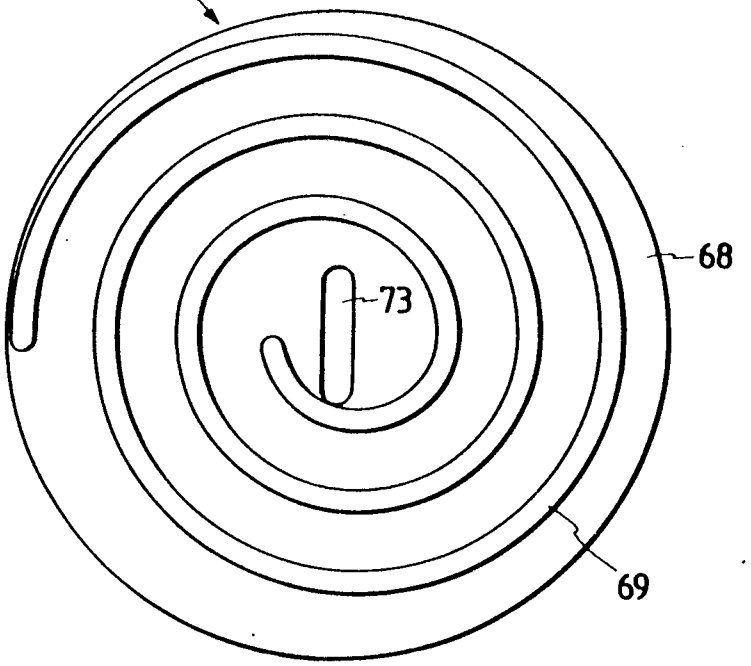
FIG. 3(*a*) is a bottom view of the driving scroll of the fluid scroll machine.
Figure 3A:
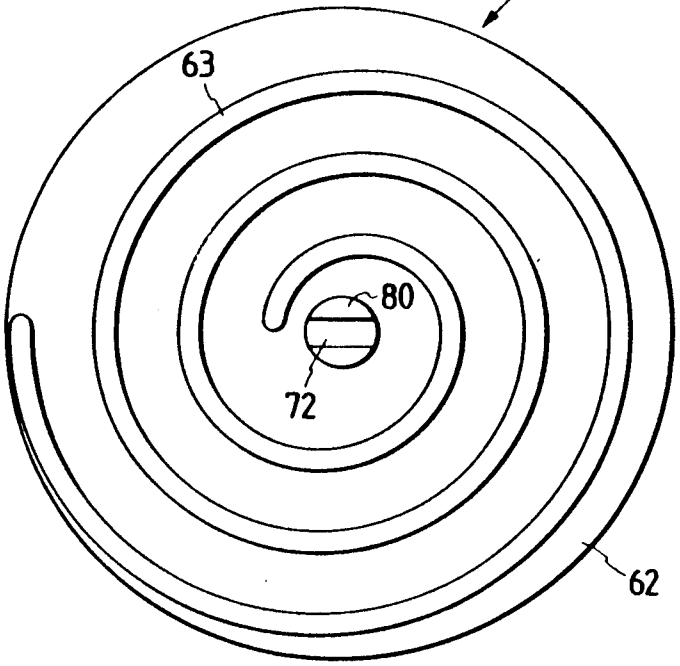
Figure 4:
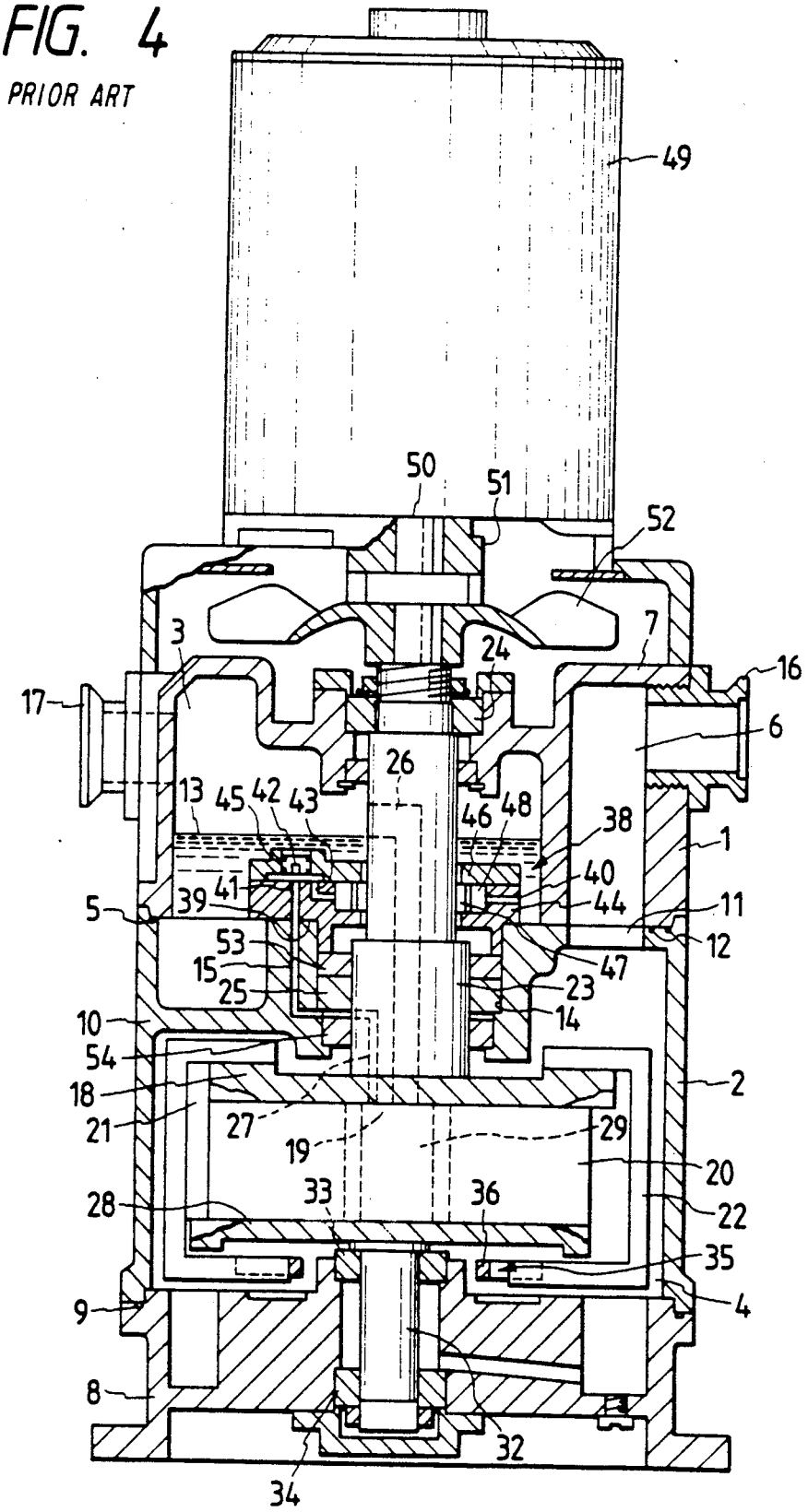
FIG. 4 PRIOR ART
FIG. 4 is a sectional view of a conventional fluid scroll machine.

FIGS. 1, 2 and 3 show a fluid scroll machine which is the embodiment. The fluid scroll machine is the same in constitution and operation as the conventional fluid scroll machine shown in FIG. 4, except for differences described from now on. The fluid scroll machine shown in FIGS. 1, 2 and 3 includes a driving scroll 61, a driving shaft 64, a driven scroll 67, a driven shaft 74, and an cylindrical-shaped Oldham's coupling 75. The driving scroll 61 has a circular base plate 62 and a vortical portion 63 provided on the base plate, and is disposed in the intake chamber of the machine. The driving shaft 64 extends in the axial direction of each of the upper and lower cylindrical casings of the machine, and is rotatably supported with bearings by a partition wall and a bearing support and coupled to the central portion of the driving scroll 61. The driving shaft 64 has an exhaust passage 65 communicating with a discharge port, and an oil feed passage 66 communicating with a hermetically closed space 70 described hereinafter. The driven scroll 67 has a circular base plate 68 facing the base plate 62 of the driving scroll 61, and a vortical portion 69 provided on the base plate 68, and is disposed in the intake chamber and eccentrically combined with the driving scroll. The driving and the driven scrolls 61 and 67 define the hermetically closed space 70, which moves from the peripheral portions of the scrolls toward the central portions thereof as the scrolls are rotated synchronously with each other. Each of the central parts of the vortical portions 63 and 69 of the driving and the driven scrolls 61 and 67 is notched by a half round from the center of the vortical portion so that an opening 71 is defined between the scrolls. The central portions of the base plates 62 and 68 of the scrolls 61 and 67 have grooves 72 and 73 which extend perpendicularly to each other and are open to the opening 71. The driven shaft 74 extends in the axial direction of the driving shaft 64, and is rotatably supported with bearings by the cover of the machine and coupled to the central portion of the driven scroll 67. The Oldham's coupling 75 has key-like projections 76 and 77 provided on the top and bottom of the body of the coupling and fitted in the grooves 72 and 73, and is disposed in the opening 71 so as to transmit the torque of the driving scroll 61 to the driven scroll 67. The driving shaft 64 has a tapped hole 78, which is used to manufacture the exhaust passage 65. A blind screw 79 is engaged in the tapped hole 76. The groove 72 of the central portion of the base plate 62 of the driving scroll 61 is provided in the projection 80 of the base plate.

Since the driving and the driven scrolls 61 and 67 are connected to each other by the Oldham's coupling 75 provided in between the scrolls to transmit the torque of the driving scroll to the driven scroll, the fluid scroll machine does not need to have U-shaped arms to transmit the torque of the driving scroll to the driven scroll as in the conventional fluid scroll machine. For that reason, the number of the components of the fluid scroll machine which is the embodiment of the present invention is decreased and the manufacturing of the machine is simplified. Since the driving and the driven scrolls 61 and 67 are directly connected to each other by the Oldham's coupling 75, the diameter of the coupling can be made smaller than that of the driven shaft 74. Since the Oldham's coupling 75 is located in the opening 71 between the driving and the driven scrolls 61 and 67, lubricating oil is surely and sufficiently supplied from a vane pump to the coupling through the oil feed passage 66.

What is claimed is:

1. A fluid scroll machine including two scrolls eccentrically combined with each other and defining a hermetically closed space which moves as said scrolls are rotated synchronously with each other, said scrolls including vortical portions, wherein the central parts of the vortical portions of said scrolls are notched so that an opening is provided between said scrolls; a coupling means for transmitting the torque of one of said scrolls to the other is provided in said opening, wherein each of said scrolls includes a base plate, the base plates of the scrolls having grooves which extend perpendicularly to each other and which are open to said opening, and wherein said coupling means comprises a body having key-like projections provided on a top and bottom thereof, said key-like projections being fitted in said grooves, respectively, and further wherein said coupling means is cylindrical shaped and has a diameter which is smaller than that of a driving shaft for driving one of said scrolls.

* * * * *